United States Patent [19]

Tiddy et al.

[11] Patent Number: 5,076,626

[45] Date of Patent: Dec. 31, 1991

[54] METHOD AND DEVICE FOR REPAIRING OR PROTECTING A DOOR AND KIT FOR DOING SAME

[76] Inventors: Junius A. Tiddy, 1309 Wesson Rd., Shelby, N.C. 28150; Jay J. Teddy, P.O. Box 425, Shelby, N.C. 28150

[21] Appl. No.: 683,863

[22] Filed: Apr. 11, 1991

[51] Int. Cl.[5] ..... E05C 21/00

[52] U.S. Cl. ..... 292/337; 292/1; 52/514; 49/460

[58] Field of Search ..... 49/462, 460, 503; 52/514; 292/337, 340, 346, 1; 29/526

[56] References Cited

U.S. PATENT DOCUMENTS

| | | | |
|---|---|---|---|
| 1,483,333 | 10/1922 | Capece | 70/452 |
| 2,127,891 | 8/1938 | Starling | 292/346 |
| 2,489,072 | 11/1946 | Ausubel | 70/452 |
| 2,785,565 | 3/1957 | Schlage | 292/337 X |
| 2,952,150 | 9/1960 | Matzbin et al. | 292/337 X |
| 3,666,309 | 5/1972 | Zarzycki | 292/337 |
| 3,673,605 | 6/1972 | Allenbaugh | 292/346 |
| 3,918,207 | 11/1975 | Aliotta | 49/462 |
| 3,939,680 | 2/1976 | Heidkamp | 70/452 |
| 4,080,813 | 3/1978 | McKann | 70/450 |
| 4,139,999 | 2/1979 | Allenbaugh | 70/452 |
| 4,416,087 | 11/1983 | Ghatak | 49/462 |
| 4,484,463 | 11/1984 | Hennessy | 70/452 |
| 4,635,399 | 1/1987 | Gehrke et al. | 49/460 |
| 4,699,409 | 10/1987 | Newman | 292/357 |
| 4,790,162 | 12/1988 | Thur | 70/452 |
| 4,858,384 | 8/1989 | Blankenship | 49/460 |

*Primary Examiner*—Richard E. Moore

*Attorney, Agent, or Firm*—Bell, Seltzer, Park & Gibson

[57] ABSTRACT

A method for repairing or protecting doors which includes a kit having the components to form, when assembled, a single U-shaped unit which when installed covers the area around the door latch. The repair kit comprises a multi-component system including front and rear panel pieces; one or more edge panel pieces of varyng widths, and a strike plate large enough to cover any damaged areas. The repair kit is designed for use on standard thickness doors.

10 Claims, 3 Drawing Sheets

METHOD AND DEVICE FOR REPAIRING OR PROTECTING A DOOR AND KIT FOR DOING SAME

BACKGROUND OF THE INVENTION (1) Field of the Invention

This invention relates to a method and device for repairing or protecting a door and to a kit having components for repairing or protecting a door. More particularly, this invention relates to a method and device for repairing a damaged door or protecting a door by assembling and installing a multi-component interlocking unit that not only can be easily installed on a door but also covers the damaged area, if any, and adds security against forced entry.

(2) The Prior Art

All too frequently people gain unauthorized entry to property by simply kicking a door with such force that the door and the door jamb are damaged. Once a door has been damaged it often must be replaced at substantial cost. To avoid the cost of a new door numerous types of security devices have been suggested to aid in preventing forced entry through doors, and to cover the damage caused to the doors and door frames.

One such security device is shown in U.S. Pat. No. 4,139,999 which provides a unitary U-shaped protective door shield positioned around the edge of a door in the region of the door knob and lock with its side panels overlying opposite sides of the door. This type of reinforcement shield does not provide the capability to accommodate doors of varying thicknesses. Therefore, because a device as disclosed in U.S. Pat. No. 4,139,999 is not easily adaptable to a variety of door thicknesses it will often have to be custom made to accommodate a particular door. Furthermore, these security devices are usually costly and time consuming to install.

Another protective door plate is described in U.S. Pat. No. 2,489,072 which shows a celluloid door plate used to prevent the door from becoming soiled in the area of the handle. The door plate of this patent is not intended to add security or hide damage.

SUMMARY OF THE INVENTION

In accordance with the present invention a method and device is provided for repairing or protecting doors. The invention further comprises a kit having the components to form, when assembled, a single U-shaped unit which is easily installed and covers any damaged areas. The kit comprises a multi-component system including front and rear panel pieces, and one or more edge panel pieces. The edge panel pieces are of varying widths. Lastly, the kit will normally include a reinforcement strike plate large enough to cover any damaged areas. The kit is designed to form a unit for use on standard thickness doors, which are normally one and three-eights inch, and one and three-fourth inches thick. Of course, the scope of the invention is not limited to doors of this thickness.

The front and rear panel pieces are of generally rectangular shape having an opening in each piece positioned to accommodate door latch hardware. The front and rear panel pieces have grooves running the longitudinal length of one side close to the edge thereof. The grooves are of such width and depth as to accommodate an edge panel piece in a tight fitting relationship. The edge panel piece has an opening to permit a latch or lock bolt to extend from the door and engage a striker plate in the conventional manner. The front and rear panel pieces attach to the edge panel to form a single U-shaped unit. The assembled unit snugly engages the edge of the door in the area around the latch. When the assembly unit of the present invention is installed, the door latch hardware is aligned with the openings provided in front panel piece and rear panel piece.

Often when doors have been damaged from forced entry the area of the door jamb around the strike plate is also damaged. The kit of this invention provides a reinforcement strike plate which is generally rectangular in shape and somewhat larger than the original strike plate. This strike plate has an opening to accommodate the door latch and a recessed portion around that opening to receive the original strike plate.

It is an object of the present invention to provide a method for repairing or protecting a door which not only covers the damage in the latch area but also reinforces the door providing added security against forced entry.

Another object of the invention is to provide a door kit which contains easily assembled components for forming a single U-shaped unit for covering the area around a door latch and is thus easily installed.

A still further object of the invention is to provide a multi-component device for easy assembly into a single unit for repairing or protecting a door.

Other objects features and advantages of the present invention will become apparent from the following detailed description, taken in conjunction with the accompanying drawings.

DESCRIPTION OF THE PREFERRED EMBODIMENT

Figure 1:
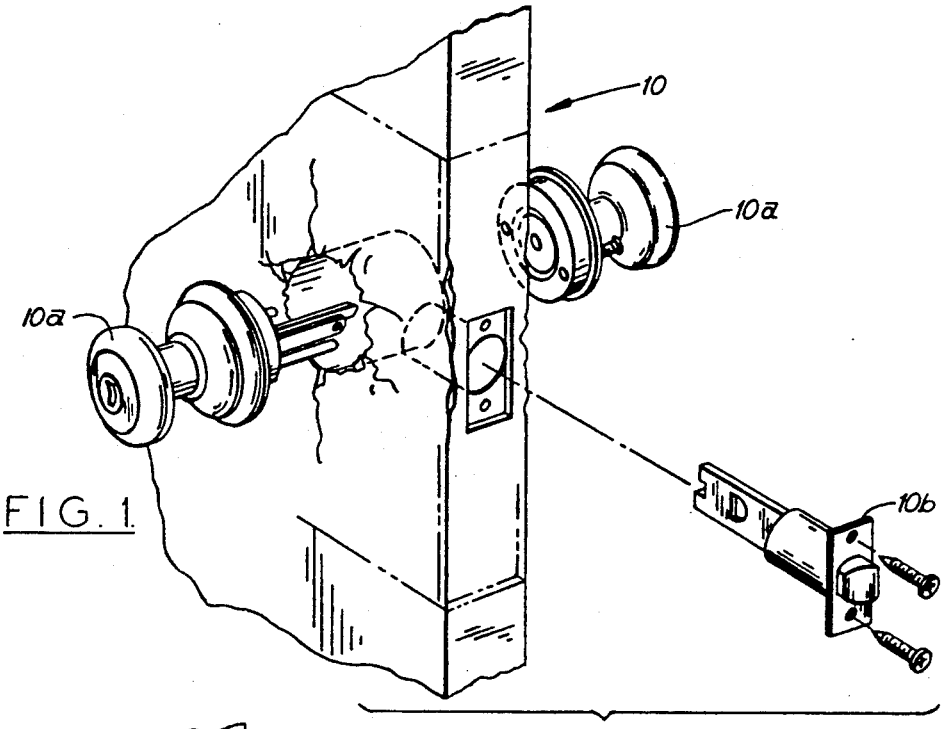
FIG. 1 is a fragmentary perspective view illustrating a door that has been damaged.

Referring now to the drawings, FIG. 1 illustrates a fragmentary view of a damaged door generally designated 10 and showing the door in damaged condition and having the door handle 10*a* and latch assembly 10*b* in dismantled position. It is damages of this type which the method and kit of this invention are best suited to repair. It should be understood that protection against future damage is also provided by this invention.

Figure 2:
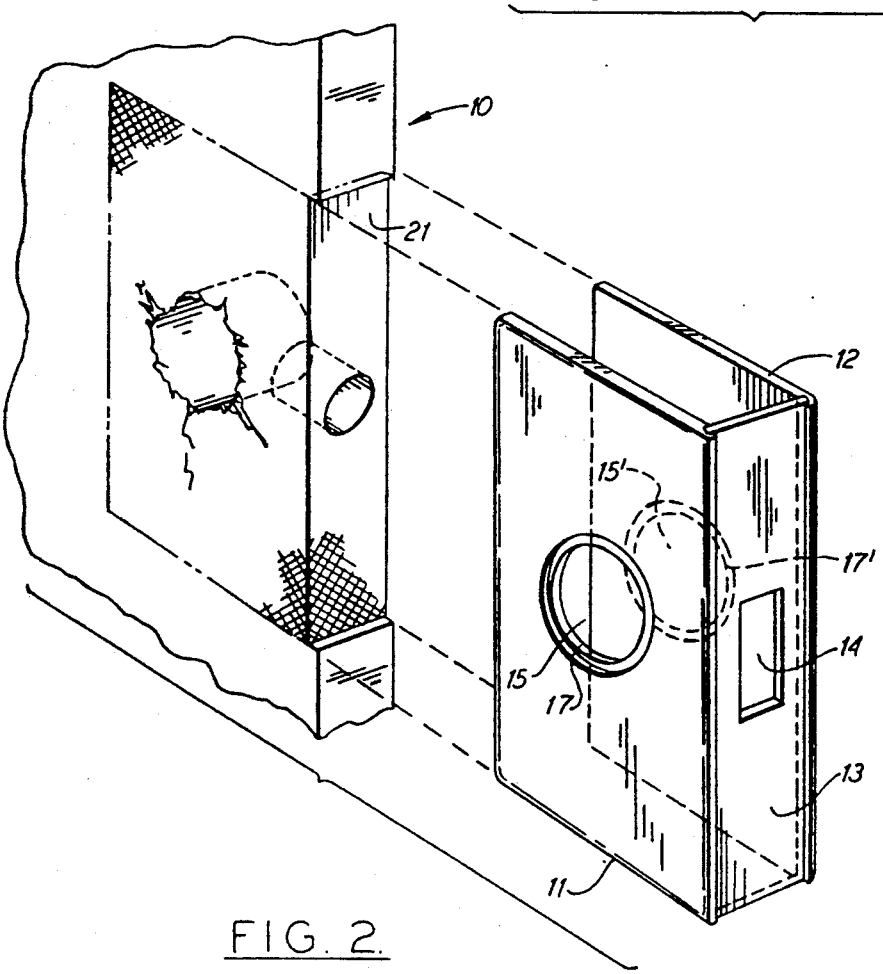
FIG. 2 is a fragmentary perspective view of a damaged door which has been prepared to receive the assembled front, rear and side panels in accordance with the principles of this invention.
Figure 5:
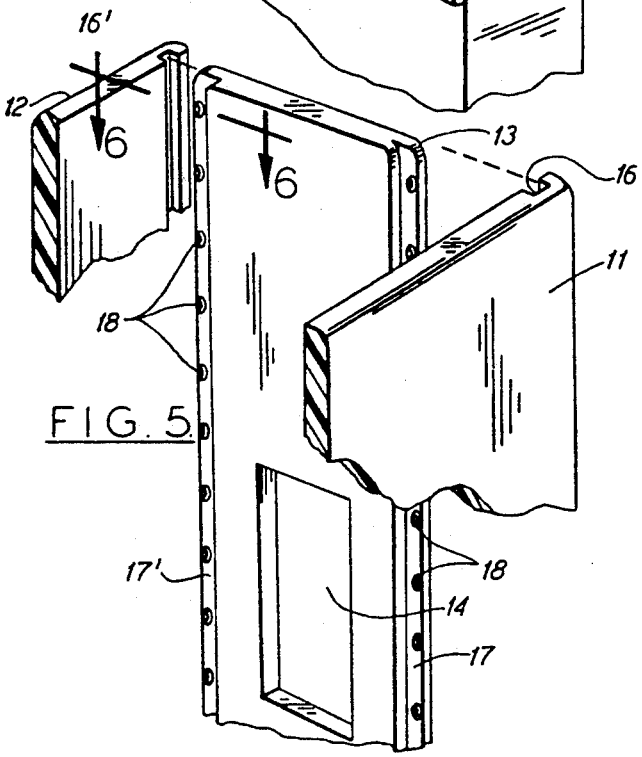
FIG. 5 is a view of three pieces of the unit shown in preassembled relationship.

As shown in FIG. 2, the assembled unit forming the device of this invention comprises a generally rectangular front panel piece 11 and rear panel piece 12 each having openings, 15, 15' through which the door hardware may pass. There are recessed rims 17, 17' around openings 15, 15' in which the door knob shield fits. The preassembled pieces are shown in FIG. 5.

Figure 4:
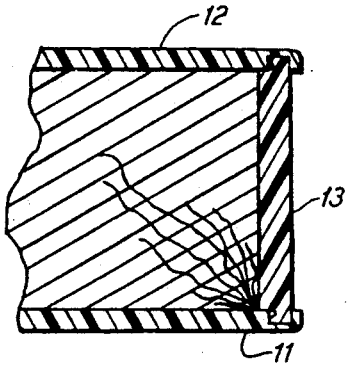
FIG. 4 is a partial fragmentary cross-section of the assembled unit formed from the pieces of the kit shown along lines 4—4 of FIG. 3.
Figure 6:
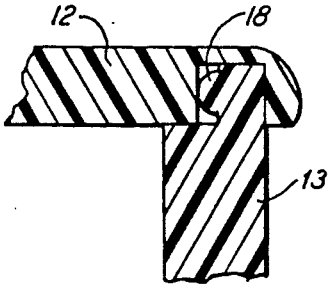
FIG. 6 is an enlarged sectional view showing the joint formed by the pieces of assembled unit.
Figure 7:
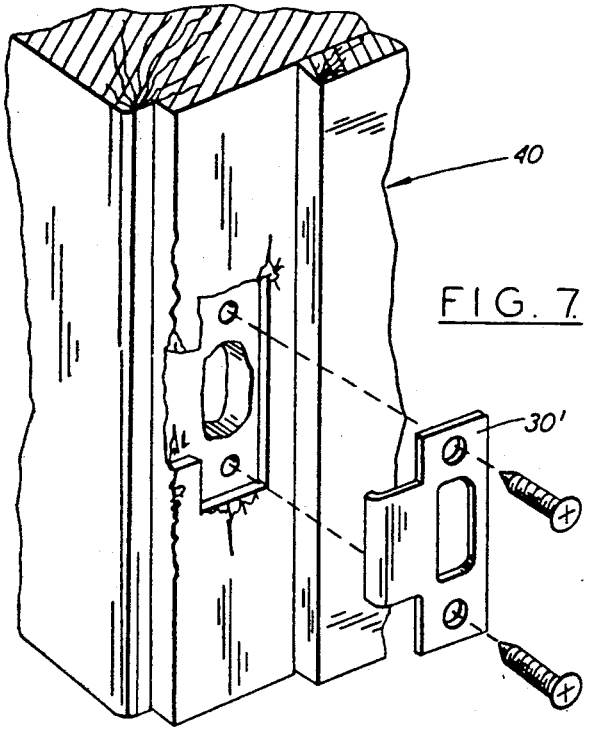
FIG. 7 is a fragmentary perspective view partially in section of a portion of a damaged door jamb.

Front panel piece 11 and rear panel piece 12 are connected to edge panel piece 13, which is generally rectangular and normally the same length as the longitudinal edge of the front and rear panel pieces. Edge panel piece 13 has an opening 14 therein sized to accommodate the face plate of the latch (FIGS. 2 and 5). The longitudinal edges of edge panel 13 are typically recessed as shown by recessed edges 17, 17' and sized to cause a snug fit when the pieces are assembled to form a single U-shaped unit. The pieces may be assembled using glue or the recessed edges of edge panel piece 13 may have a series of raised beads 18 on each recessed edge which form a tight fit as shown most clearly in FIG. 6. As shown most clearly in FIGS. 4 and 6, the front panel piece 11 and rear panel piece 12 are connected to edge panel piece 13 at grooves 16, 16' placed near a longitudinal edge of the front and rear panels. The parts of the door kit, while capable of being made from a variety of materials, are preferably made of molded plastic.

Figure 3:
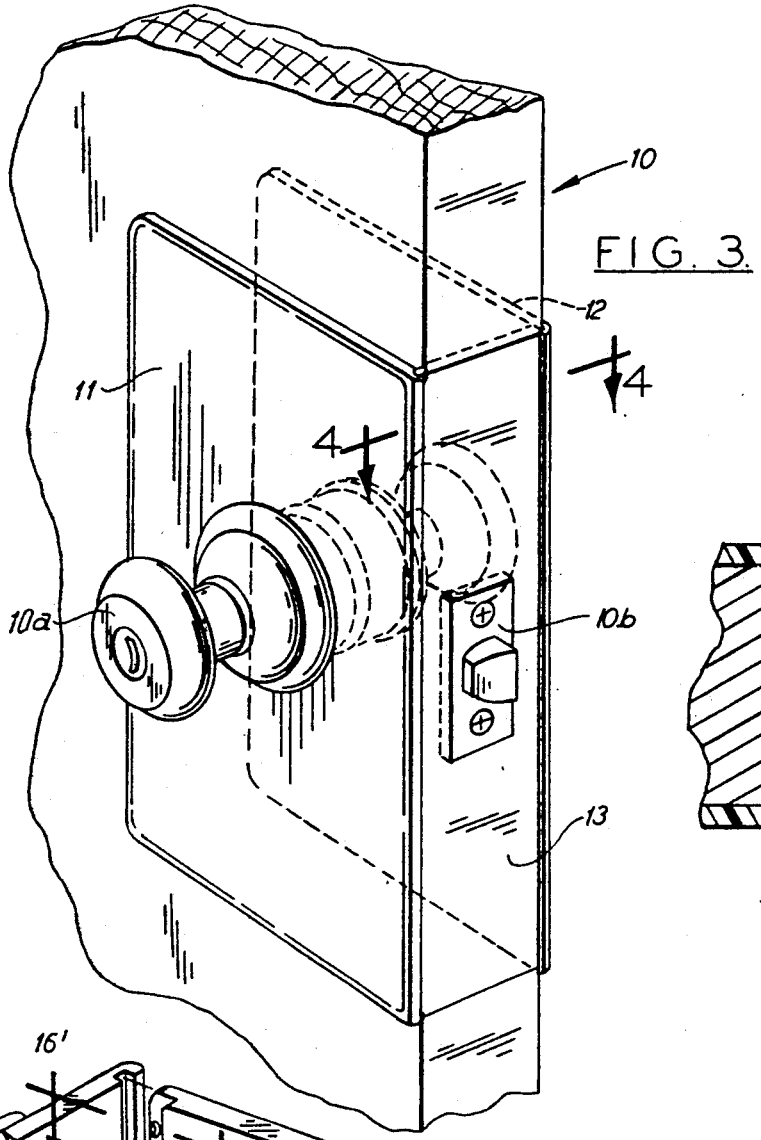
FIG. 3 is a fragmentary perspective view of a portion of a door in which the assembled unit has been installed and showing a reassembled door hardware.

Referring again to FIG. 2, the assembled unit is placed on the door 10 over the door knob shank opening and the edge of the door is marked at each end of edge panel 13. The assembled unit is removed, and the edge of the door is chiselled away to form a recess 21 which is the depth of the thickness of edge panel 13 so that edge panel 13 forms a substantially flush fit with the edge of the door 10. The assembled single unit is snugly fitted to the door 10 at the chiselled area. It is not usually necessary to glue the assembled unit in place but it may be glued, if desired. The door knob, shank, latch and related hardware are replaced as shown in FIG. 3.

Figure 8:
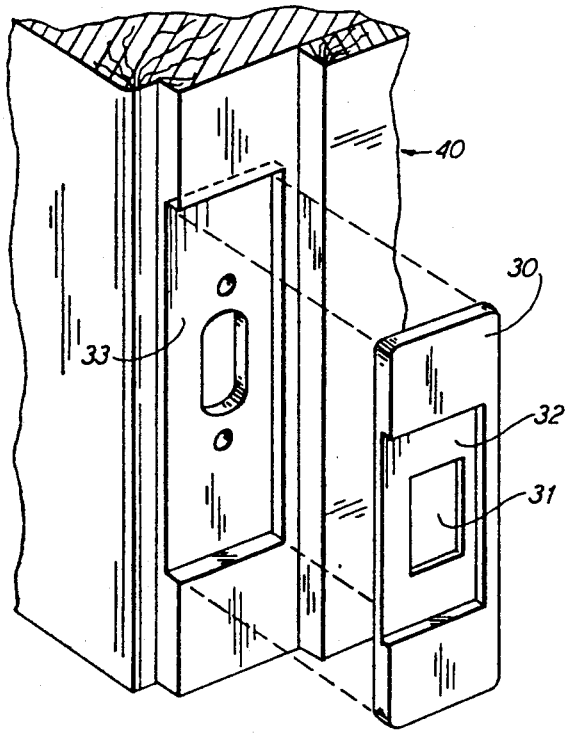
FIG. 8 is a fragmentary perspective view of a portion of a damaged door jamb which has been prepared to receive the door strike plate of this invention.
Figure 9:
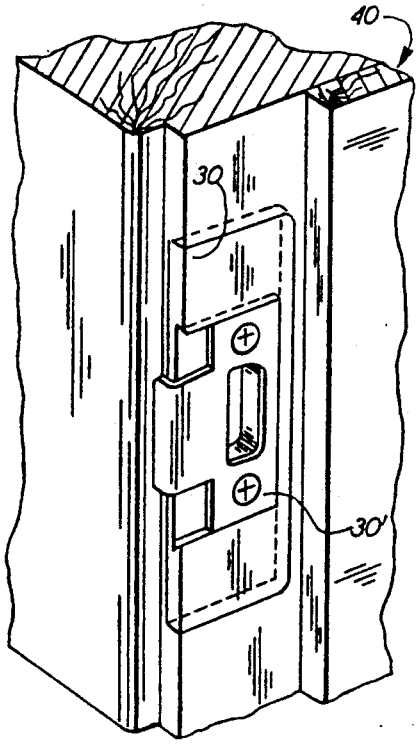
FIG. 9 is a perspective view of a fragmentary portion of a repaired door jamb.

In FIG. 8 there is shown reinforcement strike plate 30 which may be used when a door jamb 40 has been damaged or when additional protection is believed to be needed. Reinforcement strike plate 30 is generally rectangular in shape and sized to fit in a door jamb and cover damaged areas around the original strike plate 30'. Reinforcement strike plate 30 has an opening therein 31 to accommodate the latch. Reinforcement strike plate 30 also has recessed area 32 sized to accommodate the original strike plate. An area the size of reinforcement strike plate 30 is chiselled out of the jamb to form a recess 33, as shown in FIG. 8, so that the reinforcement plate fits into the recess 33 to form a substantially flush fit with the jamb. The reinforcement strike plate is secured in the chiselled-out recess 33. The existing strike plate is replaced to its original position as shown in FIG. 9.

The assembled unit of this invention is adaptable to cover conventional doors of varying thicknesses. These doors are often one and three-eighths inches, and one and three-fourths inches thick, but it is understood that the edge piece may be made to any appropriate width.

METHOD OF INSTALLATION

For a better understanding of the invention the following basic steps for the installation of the door repair kit may be followed.

Step 1: Remove all the door latch hardware from the door to be repaired or protected from damage.

Step 2: Apply glue to the grooves of the front and rear panel pieces. Insert longitudinal edge of edge piece into each groove to form a complete U-shaped unit. Alternatively, in repair kits having beads on the longitudinal edges of the edge piece the front and rear panel pieces may simply be snapped into place.

Step 3: The completed U-shaped unit is placed on the door and the edges are marked.

Step 4: The unit is removed and the edge of the door is chiseled to accommodate the depth of the latch plate.

Step 5: If desired, glue, such as, LIQUID NAILS TM is applied within the marked area and the completed unit installed and the lock replaced.

Step 6: If the area around the strike plate on the jamb has been damaged, the strike plate is removed and chiselled to a depth to accommodate the reinforcement strike plate and the original strike plate is reinstalled over the reinforcement strike plate.

By way of the present invention, an inexpensive method is provided for repairing or protecting a door, which provides a device constructed from a kit which is of simple construction and easily installed, from forced entry.

It will be appreciated that various details of the present invention are not to be construed as being limited by the illustrative embodiments. It is possible to produce other embodiments without departing from the inventive concepts of the invention. Such embodiments are within the ability of those skilled in the art.

What is claimed is:

1. A method of repairing or protecting a door which comprises:

(a) removing all door lock hardware from the door to be repaired or protected;

(b) attaching a front panel piece and a rear panel piece each having an opening therein to accommodate door latch hardware to an edge panel piece by securing a longitudinal edge of said front and rear panel pieces to said edge panel piece to form an assembled U-shaped unit;

(c) placing the assembled U-shaped unit on the door in the location where it is to be installed, and marking the door in said area where said unit is to be installed;

(d) removing door material from edge of door within the marked area whereby said unit will fit substantially flush with the edge of the door when installed;

(e) securing said U-shaped unit to the door; and (f) installing door latch hardware.

2. The method according to claim 1 further comprising removing the strike plate from a door jamb; repairing the damaged area by chiselling out an area the size of a reinforcement strike plate to whereby the reinforcement strike plate fits substantially flush with the door jamb; securing said reinforcement strike plate to the repaired area; replacing the strike plate.

3. The method according to claim 1 wherein said unit is secured with glue.

4. A door repair kit having component parts capable of being assembled at the site of a damaged door or a door to be protected comprising;

a multi-component interlocking three piece assembly, wherein said assembly is formed by joining a front panel piece and a rear panel piece together by an edge panel piece; said assembly is adapted to snugly engage the edge of a door in the area of the door latch mechanism with said front panel piece and said panel piece overlying opposite sides of said door, said front and rear panels having an opening therein to receive a door latch mechanism;

said edge panel being vertically elongated and having an opening therein for receiving a latch face plate and grooves along the elongated sides capable of accepting said front and rear panels to form a complete unit whereby said complete unit may be slidably positioned over the latch portion of said door.

5. The kit of claim 4 further comprising a reinforcement strike plate.

6. The kit of claim 4 wherein said kit contains a plurality of edge pieces of varying thickness.

7. The kit of claim 4 wherein said front panel piece and said rear panel piece are generally rectangular.

8. The kit of claim 4 wherein said front panel piece and said rear panel piece have a recessed portion around each of said openings.

9. A door repair and protection unit comprising substantially rectangularly configured front and rear panels spaced in substantially parallel, opposing relationship to each other and forming front and rear longitudinal edges, said panels being spaced a distance approximately equal to the thickness of the door to be repaired, each panel having an opening therein to accommodate the door latch hardware, a longitudinal groove formed in the front edge of each panel, an edge panel substantially the same length of the longitudinal front edges of front and rear panels, said edge panel including longitudinal edges having a recessed portion along the edge and of a depth to form a recessed edge portion dimensioned for frictional, locking engagement into the grooves formed in the front edges of front and rear panels for locking the edge panel to front and rear panels and forming a substantially U-shaped unit, said edge panel having an opening for accommodating the face plate of a door latch.

10. A door repair and protection unit according to claim 9 wherein said recessed edge of said edge panel includes a plurality of raised beads for forming an interference fit with said groove.

* * * * *